United States Patent [19]

Watson

[11] Patent Number: 4,714,293

[45] Date of Patent: Dec. 22, 1987

[54] DUST CONTROL FLUIDS SPRAY ARM

[75] Inventor: John H. Watson, Shinnston, W. Va.

[73] Assignee: Sun Hydraulics, Inc., Shinnston, W. Va.

[21] Appl. No.: 839,999

[22] Filed: Mar. 17, 1986

[51] Int. Cl.[4] ..... F21C 35/22

[52] U.S. Cl. ..... 299/12; 239/165; 299/43

[58] Field of Search ..... 299/12, 81, 42, 43, 299/53, 17; 239/719, DIG. 8, 164, 165, 169, 587; 98/50

[56] References Cited

U.S. PATENT DOCUMENTS

| | | | |
|---|---|---|---|
| H,000,023 | 2/1986 | Riester et al. | 239/165 |
| 2,693,950 | 11/1954 | Calder | 299/76 |
| 2,743,095 | 4/1956 | Wright | 299/59 |
| 4,084,855 | 4/1978 | Miles et al. | 299/64 |
| 4,157,204 | 6/1979 | Kissell et al. | 299/64 |
| 4,289,509 | 9/1981 | Holter | 55/257 PV |
| 4,358,160 | 11/1982 | Kissell et al. | 299/43 |
| 4,375,904 | 3/1983 | Beckmann et al. | 299/81 X |
| 4,471,997 | 9/1984 | Best | 299/12 |
| 4,488,759 | 12/1984 | Bergqvist | 299/81 |
| 4,494,894 | 1/1985 | Divers et al. | 299/12 X |

FOREIGN PATENT DOCUMENTS

| | | | |
|---|---|---|---|
| 1304584 | 8/1962 | France | 299/17 |
| 621872 | 8/1978 | U.S.S.R. | 299/17 |

*Primary Examiner*—James A. Leppink
*Assistant Examiner*—David J. Bagnell
*Attorney, Agent, or Firm*—Hall, Myers & Rose

[57] ABSTRACT

Provided is a dust control attachment for long wall mining equipment featuring a water spray head fixed on the end of an arm which is mounted in a manner to be movable in the horizontal and vertical planes whereby the spray is substantially directable to any desired situs during mining operations.

23 Claims, 3 Drawing Figures

FIG. 1
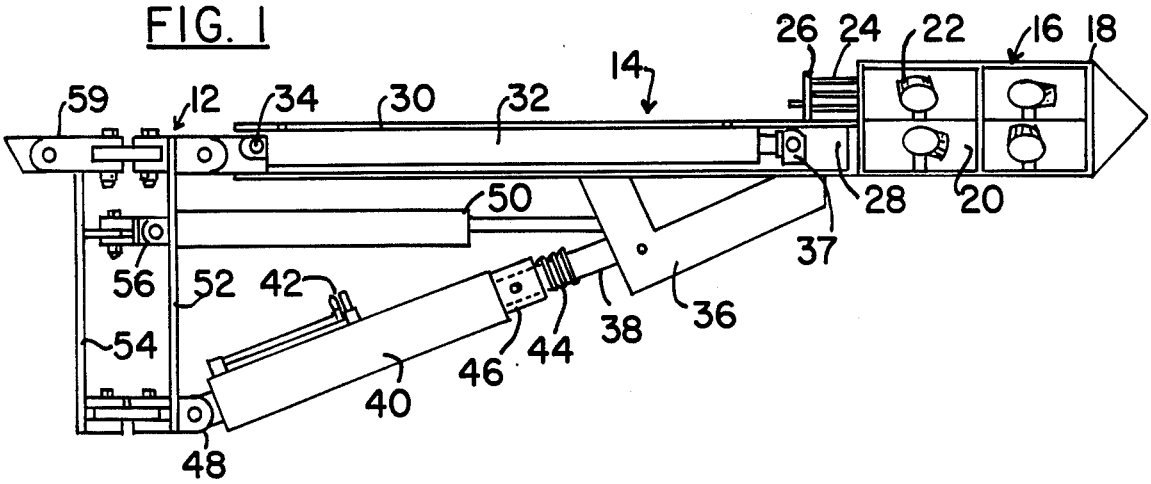
FIG. 2
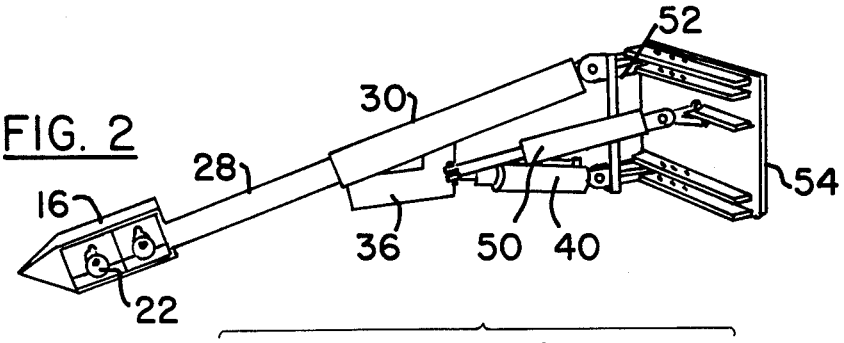
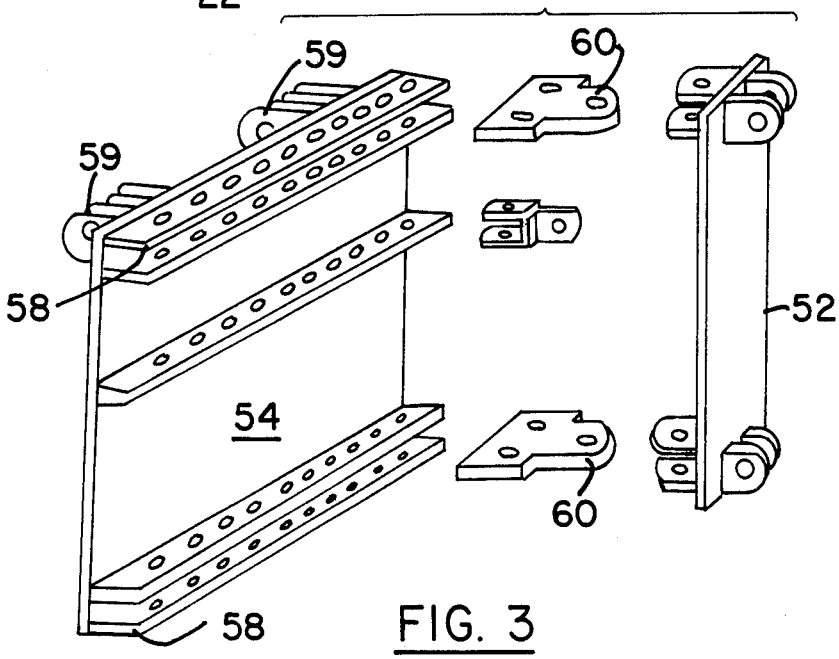
FIG. 3

DUST CONTROL FLUIDS SPRAY ARM

TECHNICAL FIELD

The present invention relates to dust control in mining operations, and, more particularly, to an extendable and retractable armature assembly with spray venturi for attachment to a long wall mining device.

BACKGROUND OF THE INVENTION

Dust formation during the course of mining operations has been a long-standing problem in the industry. With the advent of modern high-speed cutting and pulverizing equipment, those problems associated with dust formation have increased. The problems are particularly acute in long wall mining of coal where shears chop one length of wall up to 1500 feet in length in one continuous operation.

Among the problems are inhalation of dust particles by mining personnel, fire and explosion, machine tool wear from particle invasion of moving parts, etc. Avoidance of these and other problems have led to the advent of numerous devices for providing maximum ventilation, spraying the air with water in the general vicinity of the cutting operations, and even vacuuming or aspirating the air immediately surrounding cutting operations.

Irrespective of health and maintenance problems, governmental regulation also must be satisfied. Standard have been and continue to be promulgated which define acceptable mine dust levels.

Water spray is one popular control techniques because it is generally efficient and economical. Known water spray techniques are employed to reduce the quantity of dust at the work site thereby minimizing the above-mentioned health danger to workers as well as equipment fouling problems caused by the dust. One key point for water spray application is that it is most efficient when the spray is concentrated directly at the cutting site.

Examples of devices employed for this purpose are found in U.S. Pat. No. 4,358,160 describing a long wall shear or mining machine with a series of water-spray nozzles fixed along the upper surface of the mining device and on a static arm extending along the backside of the main body of the machine. One of the static arms depicted not only serves to support the nozzles but also serves as the support for a passive curtain barrier. In operation, the nozzles spray water in a direction behind the machine with the intention of generating a quasivertical laminar air flow to contain the dust created during the mining operation from the operator.

Another device, illustrated in U.S. Pat. No. 4,488,759, is directed to controlled fluid spray application at a work site such as a coal seam whereby dust generated by the impacting of the tool is entrained within and by the fluid spray.

One additional consideration for construction and maintenance of fluid spray devices is protection. During long wall mining operations, large rocks or sections of coal may fall onto the top of the shearing machine and can damage fixed position, stable components of that machine. It has been known that falling debris, when large enough, will develop sufficient force to cause serious damage by snapping components from the machine.

SUMMARY OF THE INVENTION

It is an object of this invention to provide a dust-control system, particularly for use in long all mining operations.

It is another object of this invention to overcome the problems of the prior art.

Still another object of this invention is to provide a dust-control device which is operable independent or dependent of associated shearing equipment.

Still another object of this invention is to provide a device which is independently actuable and movable relative to associated shearing equipment.

Yet another object of this invention is to provide a device which permits fluid spraying to be directed specifically at cutting sites.

Still another object of this invention is to provide a dust-control, fluid-spray means which is resistant to damage from falling debris generated during cutting operations.

It is another object of this invention to provide a spray means which employs water supplied and pressurized long wall equipment.

These and other objects are satisfied by a dustcontrolled device having a substantially linear, elongated arm comprising a first and second sections. At least part of the second section is mountable and translates linearly relative to the first section and the device incorporates a means for extending and retracting the second section relative to the first section. A shock absorbing means is mounted to the arm at an angle relative to the direction of elongation of the arm where the shock absorption means is capable of absorbing substantial vertical vector components of shock impact forces on the arm. A fluid spray means is disposed on the second section and there is a fluid communication means for supply pressurized fluid to the spray means.

The invention contemplated herein is principally directed to long wall mining technology. It provides a combination of features which have already proven to be desirable in mining operations. Principally these features are actuation and movement of the nozzle sprayhead which can be dependent or independent of the movement of the mining device. The spray, therefore, is easily directable to the cutting situs. It is not necessary that the device be incorporated with the cutting means but is in close enough proximity that effective dust control is realized. Not only does the independent control of the invention facilitate efficient dust control but also it makes for much easier maintenance in contrast to integrated spray-shearing equipment. Also, the device contemplates protection of spraying means from falling debris. This protection falls in two distinct categories, the first being merely to shield the fluid issuing venturi and nozzles from falling debris, and the second is to protect the armature from shock-impact forces created by falling debris. Considerable damage can be sustained by equipment when a heavy chunk of dislodged coal falls onto devices where no provisions for protection have been made.

Another desirable aspect of the invention is that the water necessary for its operation is supplied by existing equipment in the long wall mining device. Consequently, no additional water supply or pumping equipment is necessary for its operation. The prior art simply does not contemplate the arrangement generally described above and described in greater detail herein below.

BRIEF DESCRIPTION OF THE DRAWINGS

FIG. 1 is a side view of the invention.

FIG. 2 is an opposite side view of an alternative form of the invention.

FIG. 3 is a perspective assembly view of the mounting assembly for mounting the armature to conventional long wall mining equipment.

DETAILED DESCRIPTION OF THE DRAWINGS

Dust control arm assembly FIG. 1, features three principal sections, mounting assembly 12, movable elongated armature 14, and spray venturi head 16. As illustrated in FIG. 1, venturi head comprises a steel housing 18 containing four individual chambers 20 which house venturi nozzles 22. Housing 18 is provided principally to protect the venturi from damage caused by falling debris. There are four chambers 20, each containing individual directable venturi. Commercially available steel venturi perform satisfactorily. Examples of such venturi are the PD 1941 from Elmac Corp., the Preiser Scientific Corp. #92-5044, and the Fairmount Supply Co., #65251522. Each venturi has a $\frac{3}{8}$ inch threaded brass nozzle which generates water spray. The nozzle base is standardized which allows for substitution whereby the spray can be customized to needs.

Venturi nozzles 22 are in fluid communication with tube members 24 extending from the back-side of venturi head 16 and are secured by steel-encased valve positioning member 26 which is secured by welding or other appropriate means to the front end of armature 14.

In the illustrated embodiment, armature 14 constitutes two interfitting, extendable members, preferably L-shaped or C-shaped steel elements; extendable venturi support 28 and main arm or boom 30. Venturi support 28 is retractable or extendable as it is slidable along main arm 30. In an embodiment, hydraulic jack 32 effects extension and retraction of support 28 and arm 30 between 68 inches and 92 inches. Jack 32 is connected via coupling 34 at the mounting end of arm 30 and its piston is secured by yoke coupling 37 or other appropriate connection means to support 28. Accordingly, as the piston translates, arm 30 extends or retracts. The conventional hydraulic tubing attachments, which connect jack 32 to some remote source of pressurized fluid, are not illustrated in an effort to avoid cluttering the illustrations.

Extending below and securely affixed to main arm 30 is angled brace 36. Brace 36 has an aperture that serves to slidably secure piston 38 of hydraulic assembly 40 at an acute angle relative to the direction of elongation of armature 14. Assembly 40 further features hydraulic connector 42 which is in fluid communication with a remote source of pressurized hydraulic fluid. Disposed along piston 38 is shock-absorbing compression spring 44 which is positioned between brace 36 and piston flange 46. Flange 46 is securely fixed around piston 38 and serves to control vertical pivotal movement of armature 14. Flange 46 is capable of movement on piston 38. Its movement is limited to between positions when piston 38 is fully retracted where it abuts the front end of assembly 40 and when piston 38 is fully extended where flange 46 via spring 44 abuts brace 36. As is evident from the drawing, assembly 40 is connected to mounting assembly 12 via swivel yoke connector 48.

Also connected to brace 36 is horizontal stabilizer 50 which amounts to little more than a conventional shock absorber with hydraulic shock impact damping and displacement capacity. Stabilizer 50 is connected to brace 36 in a manner to pivot horizontally relative thereto. Unlike armature 14 and assembly 40, the back ends of which are pivotally connected to swivel connecting plate 52, the back end of stabilizer 50 is pivotally connected to mounting base plate 54 with swivel connector 56. In viewing FIG. 2, it is easily observed that the connection is offset from swivel plate 52.

Base plate 54 is constructed of a heavy gauge steel in a rectangular configuration. It is designed to attach to the cutting face side of a long wall machine via conventional mounting brackets 59 or alternate satisfactory mounting means. The front face of base plate 54 features upper and lower sets of matching perforated ledges 58. Ledge sets 58 provide secure but easily assembled and disassembled mounting of swivel plate 52 via swivel plate connectors 60.

Connectors 60 are constructed from heavy steel of similar thickness to ledges 58, and are designed to fit between the ledges. Connectors 60 have three bores in a substantially triangular configuration, two corresponding to perforations in ledge and one for connection to swivel connecting plate 52. Digressing momentarily, securing connectors 60 to ledge sets 58 and swivel connector 52 is accomplished with conventional bolts, nuts and washers which are generally employed to effect connection of most of the above-described components.

Returning to the connection assembly of swivel plate 52, it should be evident that the arrangement permits plate 52 to pivot in a horizontal plane relative to base plate 54 but also permits armature 14 to pivot in the vertical plane relative thereto. Consequently, this connection permits venturi head 16 to be directed to a desired position relative to the associated long wall mining equipment.

Reviewing mechanical operation, base plate 54 is attached to long wall equipment. Preassembled swivel plate 52 and armature 14 are attached via connectors 60. The position of armature 14 in the horizontal plane is adjusted by lengthening or shortening hydraulic stabilizer 50. This establishes a substantially fixed but resilient attachment which substantially fixes spray head 16 in the horizontal plane. The vertical position of spray head 16 is adjusted by manipulation of conventional hydraulic controls which actuate assembly 40 and cause piston 38 and flange 46 to translate relative thereto. Due to translatability of flange 46, its abutment with spring 44 and brace 36, motive force is transmitted to move armature 14 in the vertical plane. This movement is possible because of the pivotal connection between armature 14 and swivel connector 52.

Turning to another aspect of the invention, in the event debris or chunks of coal fall from the wall during mining operations and onto dust control device 10, protective elements have been incorporated to minimize damage and the effect of shock impact force on the device. First, it is preferred to shield the venturi contained within spray head. Hence, the reason for covering housing 18. Secondly, armature 14 is mounted to base plate 54 in a manner to permit two dimensional resiliency. Falling debris will generate forces having two component vectors; one horizontal and one vertical. The construction of the present invention contemplates at least some protection against both components. First, a portion of the vertical component of shock impact will be dampened and diminished by spring 44 and hydraulic jack assembly 40. In other words, a rock falling onto housing 18 will cause spring 44 to be compressed between brace 36 and flange 46. In the event the force of this vector is greater than the compression spring resistance then the hydraulic piston 38 can absorb some of the force. In the worst cause scenario, where the force is so great as to overwhelm the above-described protective measures, the connection between base plate 54 and armature 14 will yield and be damaged before the connection between base plate 54 and the long wall mining device. Accordingly, the long wall machine should remain substantially undamaged.

The horizontal force component, generated by falling debris, should be accommodated by stabilizer 50. It, as noted above, resembles a conventional shock absorber which will absorb and redistribute in time and space, a horizontal shock vector.

The fluid employed to drive assembly 40 and jack 32 may be provided by conventional air or fluid supply and control units. Preferably, to minimize costs and amount of equipment in the mine, the drive fluid is pressurized water, supplied by a pump associated with the long wall equipment. It has been determined that water pressure of at least approximately 150 psi is necessary to operate the invention properly. Higher water pressure, up to 900 psi, may also be used. The water originates from the same reservoir as that sprayed from the venturi and appropriate tubing is provided to supply both.

The illustrated embodiment incorporates features which are not critical to operation of the invention but would be featured in a deluxe model. For example, armature 14 need not be extendable and retractable. In certain embodiments, it may be desirable to construct armature 14 of a fixed length of square tubular steel. The mechanical complexity of the overall system is reduced but also the degree of directability of spray head 16 is diminished.

Another variation on the structure of armature 14 is the use of two interlifting lengths of square steel tubing. Main arm 30 may have an outer dimension of four inches square and venturi support 28, three and a half inches square. Such tubing is stronger than the angle tubing illustrated but reduces ease of maintenance by limiting access to cylinder jack 32.

In yet another modification of the illustrated embodiment, venturi may be positioned along main arm 30 or along the above-described fixed length armature. Venturi, so disposed, may be protected by a small steel shield against damage from falling debris. Such venturi will further assist in controlling dust.

These and other variations and modifications should now be readily apparent to those of ordinary skill in the art and as much, are intends to fall within the scope and spirit of the invention as defined by the following claims.

What is claimed is:

1. A dust control attachment for a long wall mining device having cutters, comprising:

a mounting member attached to said long wall mining device, a connecting means pivotally mounted on said mounting member, an elongated boom element pivotally mounted to said connecting means in a manner whereby said boom element is movable in two planes relative to said mounting member, actuation means connected to said boom element and said connecting means for pivoting said boom element relative to said mounting member, said boom element being movable independently of movement of the cutters, shock absorption means on said actuation means for minimizing the effect of shock impact force from falling objects on said boom element, said shock absorption means being capable of absorbing shock impact forces impacting at an angle relative to said boom element, means on said boom element for dispersing pressurized fluid whereby said fluid is dispersed in proximity to the cutter, and means for supplying fluid to said dispersing means.

2. A dust control attachment according to claim 1 further comprising fluid spray nozzles which are disposed along the means for dispersing pressurized fluid at pre-selected locations.

3. A dust control attachment according to claim 1 wherein said dispersing means is at least one venturi.

4. A dust control attachment according to claim 1 where said dispersing means is a plurality of venturi.

5. A dust control attachment according to claim 1 further comprising second shock absorbing means connected between said boom element and said mounting member for substantially absorbing a horizontal vector of shock impact forces.

6. A dust control attachment according to claim 1 further comprising mounting means for mounting said boom element and said shock absorbing means to reduce shock impact force effects from objects falling on said boom element.

7. A dust control attachment according to claim 6 further comprising cover protection means for shielding said dispersing means.

8. A dust control attachment according to claim 1 where said boom element comprises two members movable relative to each other and are extendible and retractable in a manner to permit said boom to move in three dimensions relative to said mounting member.

9. A dust control attachment according to claim 8 further comprising said actuation means being a hydraulically actuated jack means for moving said boom element in a vertical plane, said hydraulically actuated jack means incorporates said shock absorbing means for reducing the potential for damage to said boom from falling debris, and second jack means connected to said boom members to effect extension and retraction of said boom members.

10. A dust control attachment according to claim 1 where said shock absorption means includes a flange and a coaxially mounted compression spring and further comprising an angled brace affixed to said boom to which said shock absorption is connected in a manner where said spring is compressed between said flange and said brace upon the occurrence of severe impact force on said boom.

11. A dust control attachment according to claim 1 where said actuation means is disposed at an angle relative to said boom and said shock absorption means includes a flange and a coaxially mounted compression spring, said attachment further comprising an angled brace affixed to said boom element to which said actuation means is connected in a manner where said spring is compressed between said flange and said brace upon the occurrence of severe impact force on said boom element and a second shock absorption means connected to said mounting member and said boom element for substantially absorbing the horizontal vector of shock impact forces.

12. A dust control attachment according to claim 1 further comprising connectors and where said connecting means is a vertically disposed swivel plate incorporating connecting elements at its upper and lower ends complementary to said connectors for connection to said mounting member and said mounting member includes connecting members capable of cooperating with said connectors to connect said connecting means to said mounting member in a pivotal manner.

13. A dust control attachment according to claim 12 further including bolts and where said connectors include at least two bores sized to receive said bolts and said mounting member features ledge sets having complementary bores where said swivel plate is connected to said connector with a bolt and said connector is connected to said mounting member with at least one bolt.

14. A dust control attachment according to claim 13 where said connector has three triangularly disposed bores, said ledge sets include a plurality of bores complementary to said connector bores and said connectors are connected to said ledge sets by two bolts.

15. A dust control attachment according to claim 13 where said connector has three triangularly disposed bores, said ledge sets include a plurality of bores complementary to said connector bores and said connectors are connected to said ledge sets by two bolts.

16. A dust control attachment according to claim 13 where said connector has three triangularly disposed bores, said ledge sets include a plurality of bores complementary to said connector bores and said connectors are connected to said ledge sets by two bolts.

17. A dust control attachment according to claim 12 further including bolts and where said connectors include at least two bores sized to receive said bolts and said mounting member features ledge sets having complemetary bores where said swivel plate is connected to said connector with a bolt and said connector is connected to said mounting member with at least one bolt.

18. A dust control attachment according to claim 12 further including bolts and where said connectors include at least two bores sized to receive said bolts and said mounting member features ledge sets having complemetary bores where said swivel plate is connected to said connector with a bolt and said connector is connected to said mounting member with at least one bolt.

19. A dust control attachment according to claim 1 further comprising connectors and where said connecting means is a vertically disposed swivel plate incorporating connecting elements at its upper and lower ends complementary to said connectors for connection to said mounting member and said mounting member includes connecting members capable of cooperating with said connectors to connect said connecting means to said mounting member in a pivotal manner.

20. A dust control attachment according to claim 1 further comprising connectors and where said connecting means is a vertically disposed swivel plate incorporating connecting elements at its upper and lower ends complementary to said connectors for connection to said mounting member and said mounting member includes connecting members capable of cooperating with said connectors to connect said connecting means to said mounting member in a pivotal manner.

21. A dust control device in association with a tool, comprising:

a substantially linear elongated boom, said boom having a first and a second section, at least a portion of said second section slidably mounted on and translatable linearly relative to said first section, means connected to said first and second sections relative to said first section, means for mounting said boom on a machine, pivotal means on said boom connected to said mounting means for permitting said boom to be moved in at least two planes, actuating means connected between said boom and said mounting means for pivoting said boom, said actuating means mounted at an angle relative to the direction of elongation of said boom, shock absorbing means mounted on said actuating means, said shock absorbing means being capable of absorbing a substantial vertical vector component of shock impact forces on said boom, fluid spray means disposed on said second section, and fluid communication means for supplying pressurized fluid to said spray means.

22. A dust control device according to claim 21 further comprising said actuation means being hydraulically actuated jack means for moving said arm in a vertical plane and where said jack means incorporates said shock absorbing means for reducing the potential for damage to said boom from falling debris.

23. A dust control attachment for a long wall mining device having cutters, comprising:

a mounting member attached to said long wall mining device, a connecting member pivotally mounted on said mounting member.

an elongated boom element pivotally mounted to said connecting member, actuation means connected to said connecting member for pivoting said boom element relative to said connecting member, shock absorption means connected between said actuation means and said boom element for minimizing the effect of shock impact force from falling objects on said boom element, said shock absorption means includes a flange and a compression spring on said actuation means, an angled brace affixed to said boom and connected to said actuation means, said spring is compressed between said flange and said brace upon the occurrence of severe impact force on said boom, a linearly extendible support slidably mounted on said boom element, means connected to said support for extending and retracting said support relative to said boom in a telescopic manner, means on said support for dispersing pressurized fluid in proximity to the cutters, means for supplying fluid to said dispersing means.

* * * * *